US012098490B2

(12) United States Patent
Cheong

(10) Patent No.: US 12,098,490 B2
(45) Date of Patent: Sep. 24, 2024

(54) METHOD FOR PROCESSING BRAIDING WIG

(71) Applicant: Tae In Cheong, Qingdao (CN)

(72) Inventor: Tae In Cheong, Qingdao (CN)

( * ) Notice: Subject to any disclaimer, the term of this patent is extended or adjusted under 35 U.S.C. 154(b) by 404 days.

(21) Appl. No.: 17/462,030

(22) Filed: Aug. 31, 2021

(65) Prior Publication Data

US 2022/0030998 A1 Feb. 3, 2022

Related U.S. Application Data

(63) Continuation-in-part of application No. PCT/CN2020/113026, filed on Sep. 2, 2020.

(30) Foreign Application Priority Data

Jul. 28, 2020 (CN) ..... 202010737083.8
Jul. 28, 2020 (CN) ..... 202021515009.3

(51) Int. Cl.
*D05C 15/02* (2006.01)
*A41G 3/00* (2006.01)
*D05C 17/02* (2006.01)

(52) U.S. Cl.
CPC ..... *D05C 15/02* (2013.01); *A41G 3/005* (2013.01); *A41G 3/0066* (2013.01); *A41G 3/0075* (2013.01); *D05C 17/023* (2013.01)

(58) Field of Classification Search
CPC .... D05C 17/023; D05C 15/02; A41G 3/0066; A41G 3/005; A41G 3/0075
See application file for complete search history.

(56) References Cited

U.S. PATENT DOCUMENTS 2,253,635 A * 8/1941 Mann ..... A63H 3/44 29/432
3,162,203 A * 12/1964 Cramer ..... A41G 3/0066 132/201
3,710,740 A * 1/1973 Canziani ..... D05C 15/02 112/242
3,830,245 A 8/1974 Abbott et al.
(Continued)

FOREIGN PATENT DOCUMENTS

CN 103160109 A 6/2013
CN 205030576 U 2/2016
(Continued)

*Primary Examiner* — Danny Worrell
(74) *Attorney, Agent, or Firm* — Bayramoglu Law Offices LLC

(57) ABSTRACT

A net wig cap for processing a braiding wig includes a plurality of net pieces, where each of the net pieces is provided with patterns composed of wig threads. A method for processing a braiding wig includes: step 1: processing the net wig cap; and step 2: crocheting hair or pre-woven single-dreadlock braids onto embroidered wig threads. The present disclosure creatively applies an embroidery machine to the field of wig processing. The present disclosure first embroiders a layer of patterns composed of wig threads on a base layer of a wig by the embroidery machine, and then crochets pre-woven single-dreadlock braids onto the embroidered wig thread patterns one by one. The present disclosure does not need to manually fix the wig threads on the wig, which greatly reduces the manual workload, improves the processing efficiency and reduces the cost.

3 Claims, 2 Drawing Sheets

(56) References Cited

U.S. PATENT DOCUMENTS

| | | | | |
|---|---|---|---|---|
| 5,044,382 | A * | 9/1991 | Ando | A41G 3/005 132/54 |
| 5,957,139 | A * | 9/1999 | Bolli | A63H 3/44 132/56 |
| 10,750,809 | B2 * | 8/2020 | Kim | A41G 3/0066 |
| 2004/0168696 | A1 * | 9/2004 | Cox | A41G 3/0016 132/54 |
| 2013/0125913 | A1 * | 5/2013 | Ellery | A41G 5/0053 132/54 |
| 2015/0013708 | A1 * | 1/2015 | Chamberlain | A41G 3/005 132/54 |
| 2016/0081411 | A1 | 3/2016 | Shin | |
| 2016/0324239 | A1 * | 11/2016 | Kim | A41G 5/004 |
| 2017/0079354 | A1 * | 3/2017 | Tao | A41G 3/0083 |
| 2017/0095026 | A1 * | 4/2017 | Chung | A41G 3/0041 |
| 2022/0030998 | A1 * | 2/2022 | Cheong | A41G 3/0066 |
| 2023/0180873 | A1 * | 6/2023 | Poellnitz | A41G 5/0073 132/201 |
| 2023/0200475 | A1 * | 6/2023 | Richardson | A41G 3/0041 132/53 |

FOREIGN PATENT DOCUMENTS

| | | | |
|---|---|---|---|
| CN | 206659205 | U | 11/2017 |
| WO | 2017049095 | A1 | 3/2017 |

* cited by examiner

METHOD FOR PROCESSING BRAIDING WIG

CROSS REFERENCE TO THE RELATED APPLICATIONS

This application a continuation-in-part application of International Application No. PCT/CN2020/113026, filed on Sep. 2, 2020, which claims priority to Chinese Patent Applications No. 202021515009.3 and No. 202010737083.8, both filed on Jul. 28, 2020, the entire contents of which is incorporated herein by reference.

TECHNICAL FIELD

The present disclosure relates to the field of wig processing, and in particular to a net wig cap and method for processing a braiding wig.

BACKGROUND

Statistics show that a large proportion of wigs are sold to African Americans. The hair of African Americans is naturally thick, coarse and curly, and thus will produce an afro or frizz after growing long, which is difficult to manage. To make their hair easier to manage, African Americans usually keep their hair short or tie their hair into small braids (braiding wig) close to the scalp. The braids are not only time-consuming and expensive to make, but also are difficult to manage. In this regard, many African Americans choose to keep their hair short and wear a braiding wig.

In traditional braiding wig production, the hair is implanted into a three-dimensional head-shaped net wig cap by manual crocheting, knitting and knotting, and then woven into dreadlocks. This manual implantation method is extremely inefficient. It takes nearly 40 hours to complete the implantation of one net wig cap, combined with the time required for the subsequent braiding of the hair, leading to extremely high time costs and labor costs. For the wig factory, this production method is too inefficient, and the wigs produced in this way are priced very high, which results in low sales.

SUMMARY

In order to overcome the above shortcomings in the existing braiding wig production, an objective of the present disclosure is to provide a net wig cap and method for processing a braiding wig.

To achieve the above objective, the present disclosure adopts the following technical solution:

A net wig cap for processing a braiding wig includes a plurality of net pieces, where each of the net pieces is provided with patterns composed of wig threads;

the patterns composed of the wig threads are embroidered by an embroidery machine.

Preferably, the plurality of net pieces may include a total of 1-20 net pieces distributed in a middle part of a head along a frontal bone, a parietal bone and an occipital bone and in lateral parts of the head along temporal bones on two sides of the head.

Preferably, the patterns on the net piece may be distributed front and back along the direction of a skull.

Preferably, a breathable protective layer may be further provided beneath the net piece, and the breathable protective layer may be made of a mesh fabric.

A method for processing a braiding wig includes the following steps:

step 1: processing the above net wig cap, specifically:

S1: design: decomposing a base layer of the net wig cap into a plurality of pieces according to a head structure, and designing the patterns of each piece;

S2: embroidery: inputting the patterns designed in S1 into an embroidery machine, and embroidering the patterns on the net piece through the embroidery machine, where the embroidery machine embroiders the patterns by using wig threads, and the patterns are composed of the wig threads;

S3: cutting: cutting the base layer of the net wig cap into a plurality of net pieces by decomposing according to S1; and S4: splicing: splicing the embroidered net pieces cut in S3 into a net cap according to the head structure.

Preferably, pre-woven single-dreadlock braids may be crocheted one by one onto the wig threads of the net cap embroidered in S4.

Preferably, hair may be sequentially crocheted onto the wig threads of the net cap embroidered in S4, and braided into a style.

The present disclosure has the following beneficial effects. The present disclosure creatively embroiders a layer of wig thread patterns on the net wig cap through an embroidery machine, which provides a basic layer for implanting dreadlock braids later. In the subsequent processing, it is only necessary to crochet the hair or pre-woven single-dreadlock braids onto the embroidered wig thread patterns, which greatly reduces the manual workload and reduces the work requirements for workers. In addition, different patterns can be pre-designed according to requirements, and batch production of embroidery machines can be realized instead of manual crocheting, which improves the processing efficiency and reduces the overall cost.

DETAILED DESCRIPTION OF THE EMBODIMENTS

The present disclosure is further described below with reference to the accompanying drawings.

Figure 1:
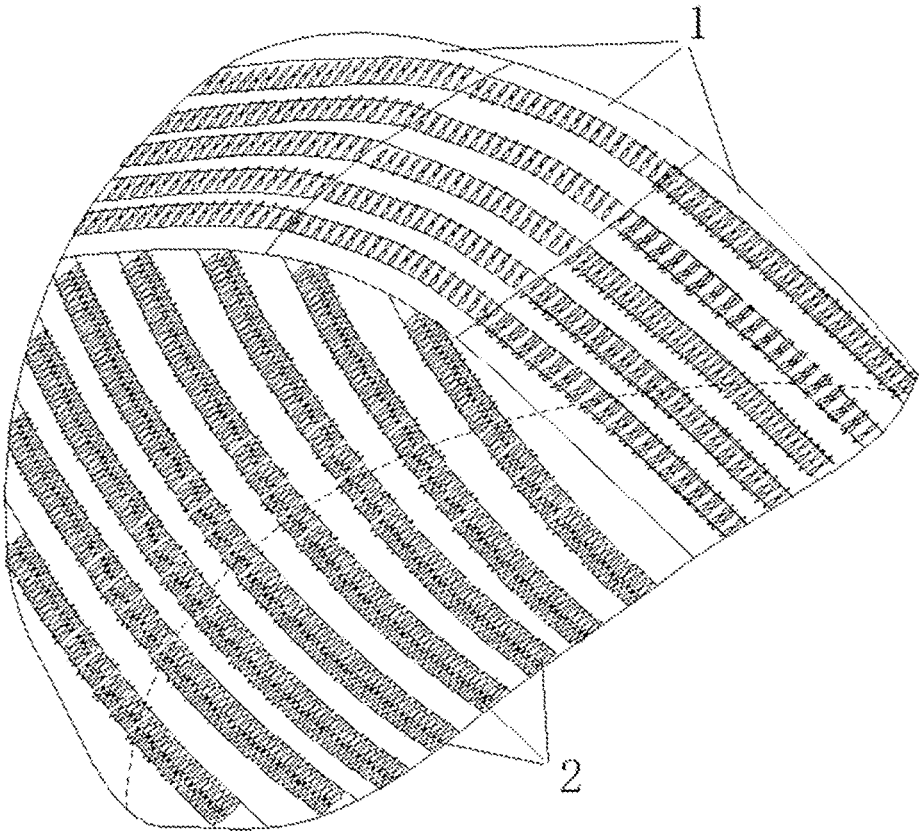
FIG. 1 is an exploded view of a net wig cap.

The present disclosure provides a net wig cap for processing a braiding wig. As shown in FIG. 1, the net wig cap of the present disclosure differs from the existing net wig cap in the following details. The net wig cap of the present disclosure includes a plurality of net pieces 1. Each of the net pieces is provided with patterns 2 composed of wig threads. The patterns composed of the wig threads is embroidered by an embroidery machine. The net wig cap may be provided with an accessory such as an elastic band, a webbing or a hanging buckle to facilitate the fixing of the net wig cap.

Figure 2:
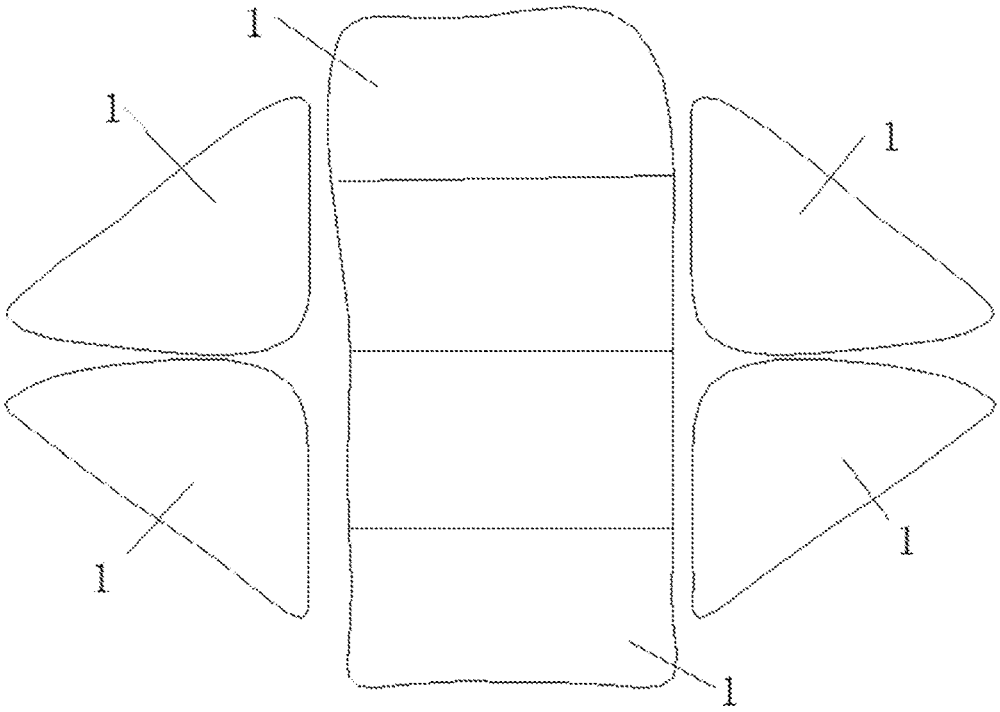
FIG. 2 is a decomposition diagram of the net wig cap.

In this embodiment, as shown in FIG. 2, the plurality of net pieces include a total of 3-5 net pieces distributed in a middle part of a head along a frontal bone, a parietal bone and an occipital bone and 2-3 net pieces distributed in lateral parts along temporal bones on two sides of the head. In a practical application, a one-piece or multi-piece (for example, 20 net pieces) net may be designed according to the need of the hairstyle, which is not limited herein.

Figure 3:
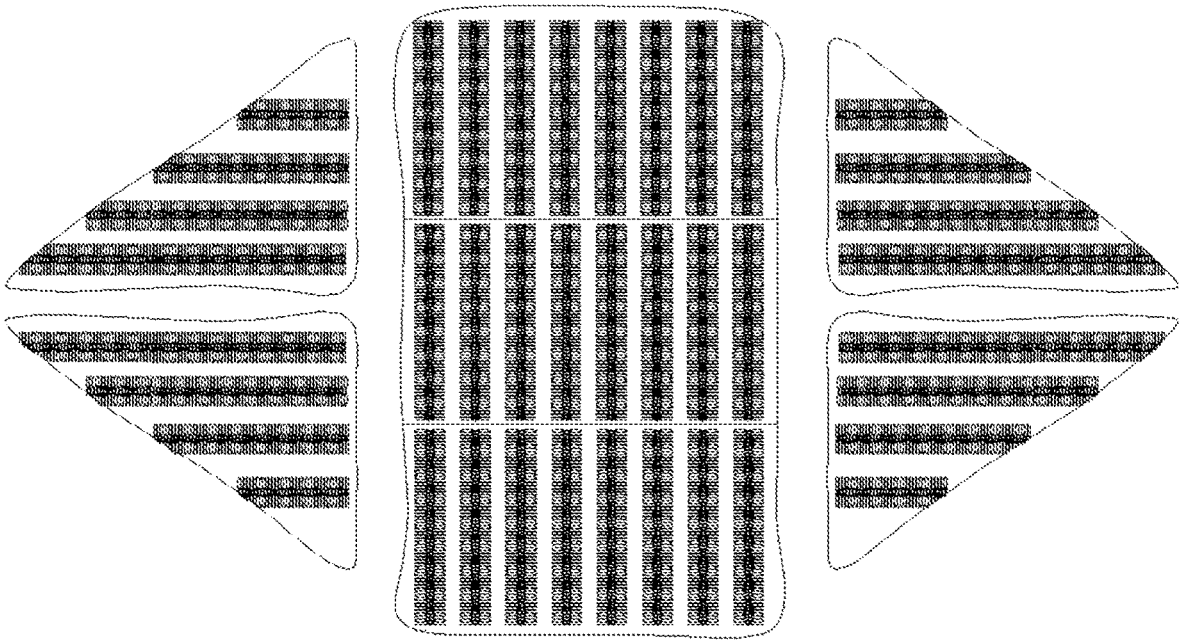
FIG. 3 is a first schematic diagram of embroidered patterns.

In this embodiment, as shown in FIG. 3, the patterns on the net piece are distributed front and back along a direction of a skull. The patterns on the adjacent net pieces in the middle part of the head correspond to each other, and the patterns on the two net pieces on the lateral parts of the head are parallel to each other. In a practical application, the patterns on the middle and lateral parts of the head may be designed to be asymmetrical front and back and left right according to the need of the hairstyle. According to the structural characteristics of the skull, different patterns are distributed front and back along the direction of the skull to design changeable and fashionable hairstyles, which is not limited herein.

In order to reduce the friction of the embroidered patterns on the scalp, a breathable protective layer is further provided beneath a base layer of the net wig cap. The breathable protective layer adopts a net structure and is made of a soft mesh fabric.

A method for processing a braiding wig includes the following steps:

S1: Design: decompose a base layer of a net wig cap into a plurality of pieces according to a head structure, and design patterns of each piece by a computer. According to a skull structure, a base layer of the net wig cap is decomposed into a middle part and lateral parts of a head. In this embodiment, 3-5 rectangular net pieces are divided in the middle part of the head along a frontal bone, a parietal bone and an occipital bone, and 2-3 triangular net pieces are divided in the lateral part of the head along a temporal bone on each side. In a practical application, a one-piece or multi-piece net may be designed for the middle part and the lateral parts of the head according to the need of the hairstyle, which is not limited herein.

S2: Embroidery: input the patterns designed in S1 into an embroidery machine, and embroider the patterns on the net piece through the embroidery machine, where the embroidery machine embroiders the patterns by using wig threads, and the patterns are composed of the wig threads.

S3: Cutting: cut the base layer of the entire net wig cap into a plurality of net pieces by decomposing according to S1.

S4: Splicing: splice the embroidered net pieces cut in S3 into a net cap according to the decomposition in S1. In this embodiment, the patterns on the adjacent net pieces in the middle part of the head correspond to each other, and the patterns on the net piece in the lateral parts of the head on each side are parallel to each other. In a practical application, the patterns in the middle and lateral parts of the head may be designed to be asymmetrical front and back and left right according to the need of the hairstyle. According to the structural characteristics of the skull, different patterns are distributed in different parts to design changeable and fashionable hairstyles, which is not limited herein. During splicing, the net pieces may be embroidered in a straight line or a non-straight line, such that the splicing position presents a natural arc.

Dreadlock braids are implanted on the net wig cap obtained in S4. Pre-woven single-dreadlock braids may be crocheted onto the embroidered wig thread one by one, or hair may be sequentially crocheted onto the embroidered wig thread, and then braided.

The embroidered patterns during design are not limited, and various patterns may be adopted as needed, as long as the dreadlock braids can be crocheted. However, according to the structural characteristics of the skull, different patterns are required to be distributed front and back along the direction of the skull. The gaps between the patterns distributed along the front and back of the skull in different parts serve as hair gaps, such that the final crocheted braids will have the same effect as the real state.

Figure 4:
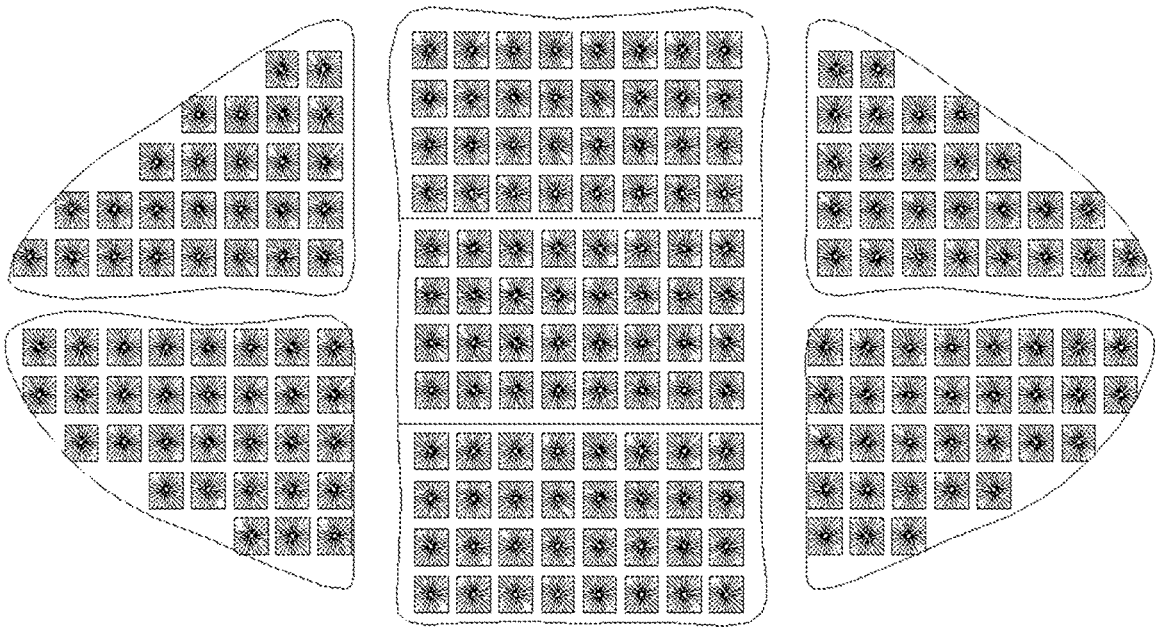
FIG. 4 is a second schematic diagram of embroidered patterns.

In actual processing, the patterns may be designed to be distributed in blocks. Of course, even if they are distributed in blocks, they are distributed front and back along the direction of the skull as a whole, as shown in FIG. 4.

In the description of the present disclosure, it should be noted that the orientation or position relationships indicated by terms such as "front end", "rear end", "left", "right", "upper" and "lower" are described based on the accompanying drawings. These terms are merely intended to facilitate and simplify the description of the present disclosure, rather than to indicate or imply that the mentioned device or components must have a specific orientation or must be constructed and operated in a specific orientation. Therefore, these terms should not be understood as a limitation to the present disclosure.

The above described are merely the preferred embodiments of the present disclosure, and are not intended to limit the present disclosure. Various changes and modifications may be made to the embodiments of the present disclosure by those skilled in the art. Any modifications, equivalent substitutions and improvements made within the spirit and scope of the present disclosure should be included within the protection scope of the present disclosure.

What is claimed is:

1. A method for processing a braiding wig, comprising the following steps:

S1: design: deconstructing a base layer of a net wig cap into a plurality of net pieces according to a head structure, and designing patterns of each net piece of the plurality of net pieces, wherein 3-5 rectangular net pieces are divided in the middle part of the head along a frontal bone, a parietal bone and an occipital bone, and 2-3 triangular net pieces are divided in the lateral part of the head along a temporal bone on each side;

S2: embroidery: inputting the patterns designed in S1 into an embroidery machine, and embroidering the patterns on the each net piece through the embroidery machine, wherein the embroidery machine embroiders the patterns by using wig threads, and the patterns are composed of the wig threads;

S3: cutting: cutting the base layer of the net wig cap into a plurality of embroidered net pieces by deconstructing according to S1; and S4: splicing: splicing the plurality of embroidered net pieces cut in S3 into a net cap according to the head structure, wherein the patterns on the adjacent net pieces in the middle part of the head correspond to each other, and the patterns on the net piece in the lateral parts of the head on each side are parallel to each other.

2. The method according to claim 1, wherein pre-woven single-dreadlock braids are crocheted one by one onto the wig threads of the net cap embroidered in S4.

3. The method according to claim 1, wherein hair is sequentially crocheted onto the wig threads of the net cap embroidered in S4, and then the hair is braided into a style.

* * * * *